US005181666A

United States Patent [19]

Bitzer

[11] Patent Number: 5,181,666

[45] Date of Patent: Jan. 26, 1993

[54] THREAD FEEDING DEVICE

[75] Inventor: Bernd Bitzer, Albstadt, Fed. Rep. of Germany

[73] Assignee: Sipra Patententwicklungs-und Beteiligungsgesellschaft mbH, Albstadt, Fed. Rep. of Germany

[21] Appl. No.: 839,948

[22] Filed: Feb. 21, 1992

[30] Foreign Application Priority Data

Feb. 26, 1991 [DE] Fed. Rep. of Germany ..... 4105981

[51] Int. Cl.[5] ..... B65H 51/20; B65H 59/00

[52] U.S. Cl. ..... 242/47.01; 242/47.12; 242/128; 242/129.8; 242/147 R

[58] Field of Search ..... 242/47.01, 47.02, 47.03, 242/47.04, 47.05, 47.06, 47.07, 47.08, 47.09, 47.1, 47.11, 47.12, 47.13, 128, 129.8, 147 R, 156; 66/132 R; 139/452

[56] References Cited

U.S. PATENT DOCUMENTS

| | | | |
|---|---|---|---|
| 3,648,939 | 3/1972 | Rosen | 242/47.01 |
| 3,687,384 | 8/1972 | Rosen | 242/47.12 |
| 3,702,176 | 11/1972 | Rosen | 242/47.01 |
| 3,831,875 | 8/1974 | Jacobsson | 242/47.13 |
| 3,926,381 | 12/1975 | Lawson et al. | 242/47.01 |
| 3,995,786 | 12/1976 | Deniega | 242/47.01 |
| 4,044,962 | 8/1977 | Calamani et al. | 242/47.05 |
| 4,153,214 | 5/1979 | Savio et al. | 242/47.01 |
| 4,180,215 | 12/1979 | Nurk | 242/47.01 |
| 4,687,150 | 8/1987 | Gutschmit | 242/47.01 |

FOREIGN PATENT DOCUMENTS

| | | |
|---|---|---|
| 2900449 | 7/1980 | Fed. Rep. of Germany . |
| 3516891 | 10/1986 | Fed. Rep. of Germany . |
| 1241781 | 8/1971 | United Kingdom . |
| 1375589 | 11/1974 | United Kingdom . |
| 2086436 | 5/1982 | United Kingdom . |

*Primary Examiner*—Stanley N. Gilreath
*Attorney, Agent, or Firm*—Michael J. Striker

[57] ABSTRACT

A strand or thread feed device, especially for circular knitting machines, is described, having a rotatable storage drum, onto which a predetermined amount of thread is wound and from which the thread is withdrawn in dependence on the thread usage. A brake ring (25) is fitted on the storage drum and consists of a base ring (29) and elastic, bristle-like elements (30) fixed thereon, preferably inclined opposite to the direction of rotation (v) and radially inwardly. In order that the storage drum may be able to accelerate abruptly to its operating speed from rest, without the brake ring (25) being retarded or even not entrained, the peripheral surface of the storage drum is provided with means, e.g. grooves with a sawtooth cross-section, which form abutment surfaces (44) transverse to the longitudinal direction of the elements (30) and with which the bristle-like elements (30) cooperate and ensure form-locking coupling between the brake ring (25) and storage drum in the direction of rotation (v).

13 Claims, 4 Drawing Sheets

THREAD FEEDING DEVICE

Figure 1:
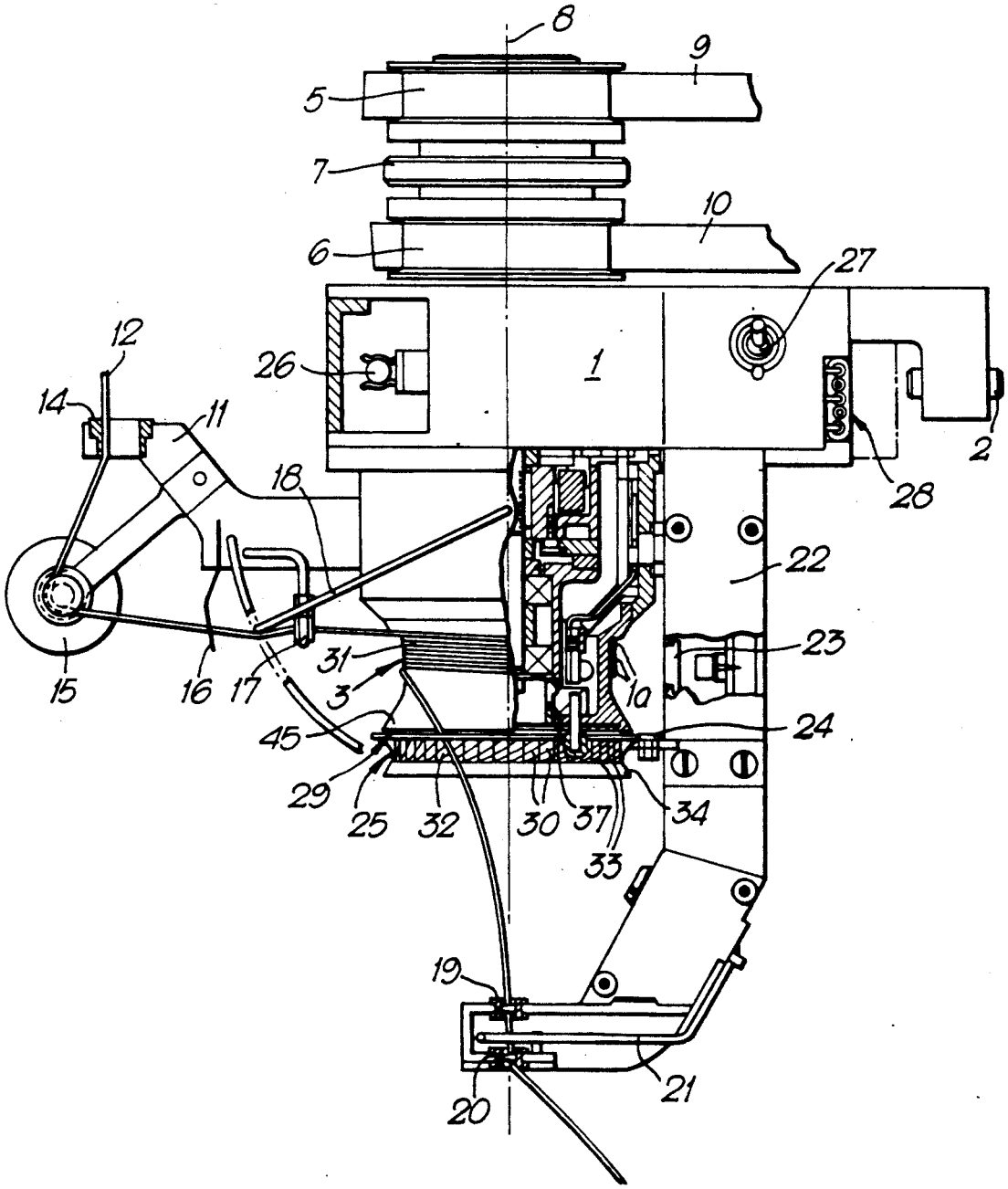

The invention relates to a thread feeding device comprising a storage drum and a brake ring fitted on an outrun section thereof, the brake ring having a base ring and a plurality of elastic bristle-like elements and serving to brake a thread being unwound from the storage drum.

In known thread or strand feed devices of this kind (DE-PS 1 900 619) the brake ring serves mainly to brake the thread uniformly, and thereby increase the thread tension, when the thread is drawn off by a device using the thread, e.g. a knitting machine or other textile machine. However, as well as this a brake ring also has the function of carrying with it the strand portion running off the storage drum during rotation of the storage drum and thus of avoiding the formation of a thread balloon in those times when the device using the thread takes off no thread or substantially no thread.

The brake ring usually consists of a base ring and elastic, bristle-like elements fixed thereto. It fits loosely and rotatable in both directions of rotation on the peripheral surface of the storage drum and is supported thereon only by the free ends of the bristle-like elements. Accordingly a compromise always has to be made between the desired braking action and the largely undesired increase in tension. This is however less critical in the known thread feed devices, because the storage drum has a relatively large diameter and is driven by its own electric motor. When this is switched on and off, the inertia effects involved are so small that the brake ring and the storage drum substantially rotate with identical rotational speed, even when the elastic forces of the bristles are comparatively small and the free end of these bristles lie in the unstressed state on a circle whose diameter is only slightly smaller than the diameter of the storage drum.

Completely different conditions arise however when a storage drum with a comparatively small diameter is for example set in rotation or stopped in that its drive shaft is selectively coupled with or uncoupled from a pulley by means of a clutch which can be thrown into and out of engagement, the pulley rotating constantly with a high speed of rotation (DE-PS 2 743 749, EP-A2 0 217 373). If the strand feed device is used in a circular knitting machine for example, this results at high knitting speeds in the storage drum being accelerated abruptly from rest to a high operating speed when the clutch is engaged, this speed being greater than that corresponding to the largest possible strand usage by the device using the thread. In such an arrangement, if the brake ring is only relatively loosely mounted on the storage drum, in order to achieve a small strand tension, unavoidable relative displacements arise between the storage drum and the brake ring on engaging the clutch. The brake ring cannot follow the abrupt acceleration of the storage drum and is therefore entrained with a delay, with the result that the thread portion running over the outrun section lifts off the peripheral surface of the storage drum and forms a thread balloon or a large loop of thread. This loop of thread is the larger the greater the acceleration of the storage drum, the smaller the thread usage by the thread utilising device at this moment and the smaller the elastic forces of the bristle-like elements are. As a result of this strand loop, the running out strand portion can come into contact with other parts of the strand feed device or the device using the strand and can break. This effect could only be avoided by suitably increasing the elastic forces of the bristle-like elements, which is however undesirable because of the consequent increase in the strand tension.

Similar problems arise using brake rings with bristle-like elements arranged radially to the axis of the storage drum (DE-PS 2 900 449). With this strand feed device also it is not possible to make a satisfactory compromise between the desired strand tension on the one hand and the necessary elastic forces of the bristle-like elements on the other hand.

The invention is based on the object of so forming the thread feeding device mentioned above that the storage drum on accelerating carries with it the brake ring with no retardation.

According to a further object of this invention the brake ring should follow the storage drum on acceleration and during rotation thereof without retardation, i.e. with substantially the same speed, even when bristle-like elements with comparatively small elastic forces are used.

Yet another object of this invention is to reliably avoid the formation of loops or balloons from the thread even when bristle-like elements are used which only exert a small braking action on the thread.

These and other objects are solved according to this invention by using a strand or thread feeding device having a storage drum the peripheral surface of which is provided with means which form abutment faces, against which the free ends of the elements abut on acceleration and rotation of the storage drum and thereby couple the brake ring in interlocking, i.e. form-locking manner with the storage drum.

The invention has the advantage that the brake ring is reliably entrained on abrupt starting of the storage drum, so that loop formation is avoided. An embodiment is particularly advantageous in which the bristle-like elements are inclined in the direction of the peripheral surface and opposite to the direction of rotation of the storage drum. Use is then made of the knowledge that the bristle-like elements are sufficiently stable in their longitudinal direction to be able to withstand the inertial forces arising on accelerating the storage drum. This is true even when they are flexible and so elastic perpendicular to their longitudinal direction that they only result in a very small strand tension during strand take-off.

Figure 2:
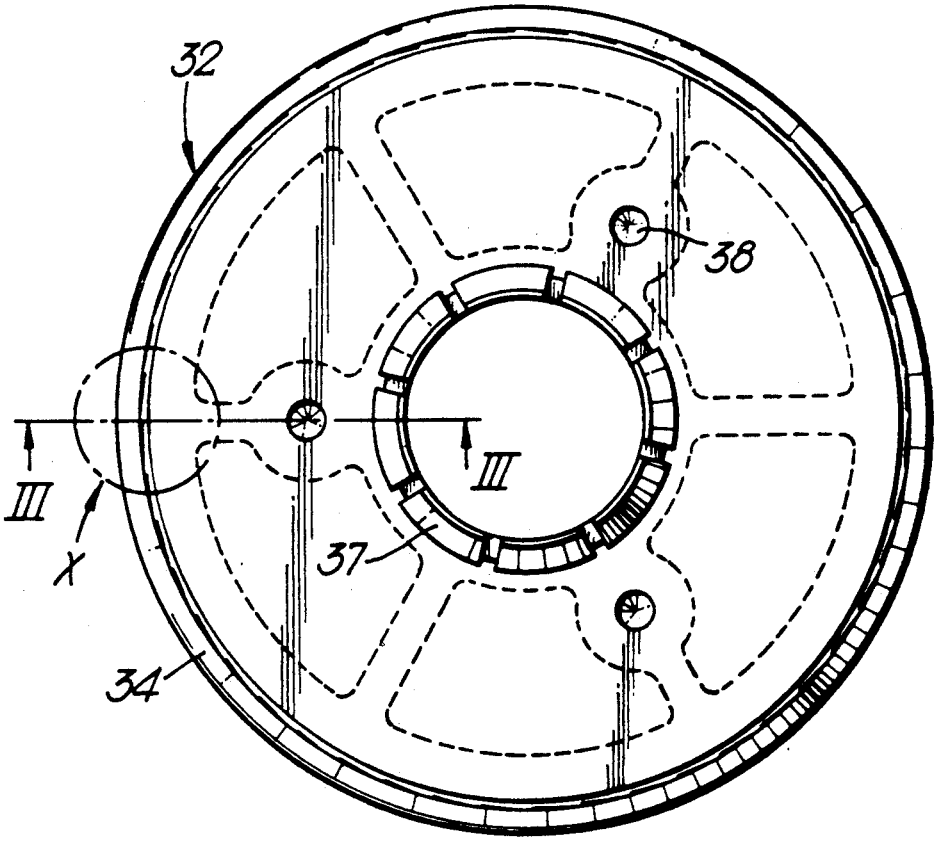
Figure 3:
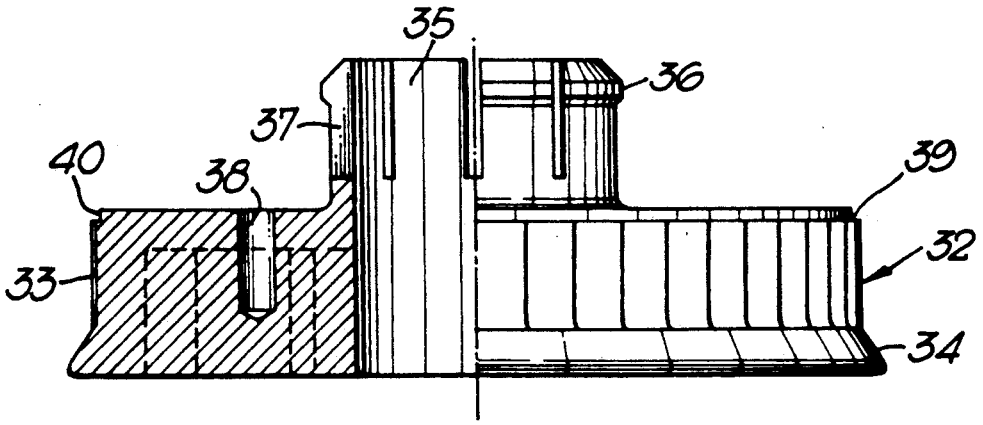
Figure 4:
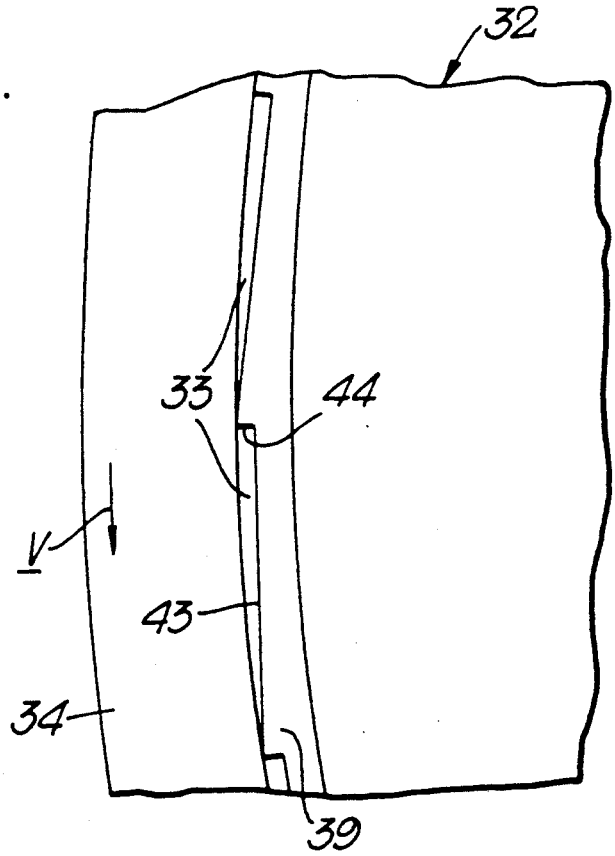
Figure 6:
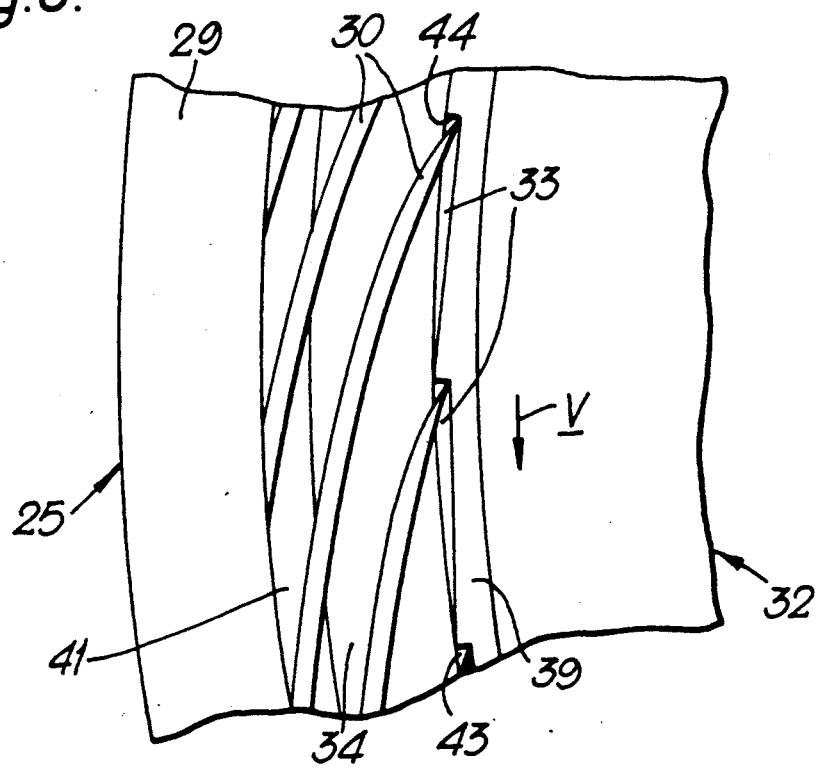
Figure 5:
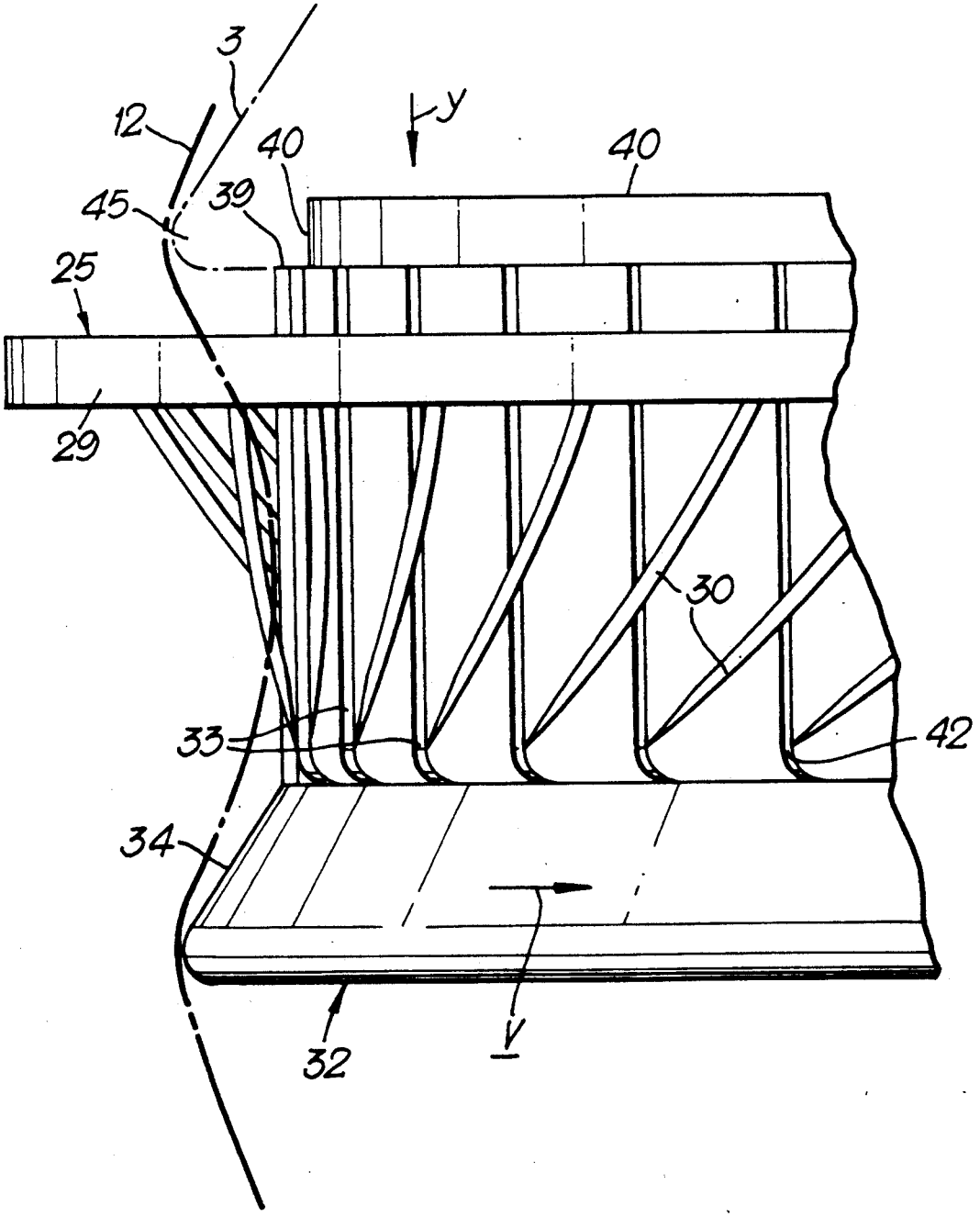

The invention will be explained in more detail below in conjunction with the accompanying of an embodiment. These show:

FIG. 1 the partially sectioned front view of a thread feed device in accordance with the invention;

FIG. 2 the plan view of a separate outrun section of the storage drum of the thread feed device according to FIG. 1, to an enlarged scale;

FIG. 3 a side view of the outrun section according to FIG. 2 with a partial section along the line III—III of FIG. 2;

FIG. 4 a detail X of FIG. 2 to a further enlarged scale;

FIG. 5 the front view of a portion of the outrun section according to FIGS. 2 to 4, with a brake ring fitted thereon, to a scale corresponding to that of FIG. 4; and FIG. 6 a view like FIG. 4 of a portion of the outrun section according to FIG. 5 in the direction of an arrow Y.

The strand or thread or yarn feeding device shown in FIG. 1 comprises a housing 1 formed as a hollow body, which can be fixed at its one end by means of a screw 2 on a mounting rail of a device using thread, e.g. a circular knitting machine. On the underside of the housing 1 is arranged a storage drum 3, which is fixed on a drive shaft rotatably mounted in the housing 1. On an upwardly projecting part of this drive shaft there are rotatably mounted two coaxial drive wheels 5 and 6, e.g. pulleys or toothed belt pulleys. In between the two drive wheels 5 and 6 an electrically switched coaxial clutch disc 7 is mounted on the shaft part so that it is rotationally fast with the drive shaft but can be shifted in the direction of a common drive axis 8 and be selectively coupled with the drive wheel 5 or the drive wheel 6. The two drive wheels 5 and 6 are set in rotation by e.g. conventional drive elements 9 and 10, e.g. belts or toothed belts, where the drive elements can be driven at different speeds with drive wheels 5 and 6 of the same diameter or can be driven at the same speed with drive wheels 5 and 6 of different diameters. Alternatively it would be possible to provide only one drive wheel, in which case the storage drum 3 could only be driven at one speed.

At the unattached end of the housing 1 there is provided a support arm 11, on which are arranged an inlet eye 14 for a thread, a yarn or any other kind of strand 12 coming from a source of supply, e.g. a conventional supply reel, a thread brake 15, a knot guard 16 and a further thread eye 17. In between the knot guard or monitor 16 and the strand eye 17 there terminates the free end of a sensor lever 18 pivotally mounted on the housing 1. A further strand eye 19, an outlet eye 20 arranged coaxially with and spaced from the eye 19 and a sensor lever 21 arranged in between these two eyes are fitted on a further support arm 22 fixed to the housing 1. This support arm 22 also serves as the support for a sensor unit 23 and a further strand eye 24. On account of the described arrangement the strand passes, with positive strand feed, through in turn the inlet eye 14, the thread brake 15, the knot monitor 16, the sensor lever 18 bearing on it and the strand eye 17 before it is fed to an upper region and essentially tangentially on to the peripheral surface of the storage drum 3 driven by the drive wheel 5 or 6. From the storage drum 3, on which the thread 12 will be wound for a plurality of turns 1*a*, the thread is then fed through the thread eye 24, through the thread eye 19, over the sensor lever 21 and through the thread eye 20 to the device using the thread 12. This take-off of the thread is not shown in FIG. 1.

In the intermittent or non-positive thread feed mode apparent in FIG. 1 and important for the purposes of the invention, the strand 12 is fed as described to the storage drum 3. However, the strand 12 does not then pass through the strand eye 24 but through an air gap, which is formed by a brake ring 25 sitting on the storage drum 3—but omitted for positive strand feed—and the peripheral surface of the storage drum 3, before it is fed through the strand eye 19, over the sensor lever 21 bearing thereon and through the outlet eye 20 to the device using the thread. In such an overhead take-off of the strand 12, the storage drum 3 is rotated intermittently, in dependence on the strand usage, and is to this end engaged or disengaged, i.e. rotated or stopped, by means of a clutch, not shown, arranged in the housing 1. As soon as the strand supply on the storage drum 3 passes below a predetermined minimum amount sensed by the sensor unit 23, the clutch engages and the storage drum is rotated. When the strand supply has reached a predetermined maximum amount, likewise monitored by the sensor 23, the clutch is disengaged, so that the storage drum 3 again comes to rest. A preferred clutch of this kind is known from DE-PS 2 743 749, to which express reference is here made.

Finally a light 26 for indicating a strand breakage sensed by the sensor levers 18 and 21, a manual switch 27 for manual operation of the clutch for positive drive and the whole current supply 28 for the sensor arms 18 and 21, the sensor unit 23, the light 26 and the switch 27 are fitted on or in the housing 1.

Strand feed devices of this kind and their operation are moreover generally known (e.g. DE-PS 2 743 749, DE-PS 2 900 449 and DE-PS 3 516 891 and also EP-A2 0 217 373), so that further explanation is superfiluous.

The brake ring 25 in the embodiment at present the most preferred is likewise implemented in known manner and pushed on to the storage drum 3 and accordingly comprises a base ring 29 and elastic, bristle-like elements 30 (DE-PS 1 900 619). These are fixed at their one ends, as FIGS. 1, 5 and 6 especially show, on the base ring 29, whole they furthermore project obliquely from the base ring 29 downwardly and inwardly. Accordingly the other, free ends of the elements 30 lie on a circle whose diameter is preferably equal to or smaller than that of the part of the storage drum 3 with which they cooperate in known manner, in order to support and centre the brake ring 25 frictionally on the storage drum 3 with the aid of the elastic forces of the elements 30. On the other hand the diameter of the base ring 29 is sufficiently greater than the associated part of the storage drum 3 for an air gap 41 (FIG. 6) to be present between the peripheral surface of the latter and the base ring 29, through which the strand 12 can be drawn off the storage drum 3.

In accordance with the invention the brake ring 25 is interlocked with the storage drum 3 in that direction of rotation in which the storage drum 3 is turned when the strand 12 is wound onto its peripheral surface. To this end the storage drum 3 is made in two parts. According to FIGS. 1 to 4, the storage drum 3 comprises a storage section 31 and an outrun section connected coaxially thereto, on which the brake ring 25 is pushed and which is formed as an annular disc for example, whose peripheral surface is substantially a continuous extension of the peripheral surface of the storage section 31 and forms therewith a continuous, common peripheral surface. In the region of the outrun section 32 the peripheral surface is provided with means 33 which form abutment faces running transverse to the longitudinal direction of the elements 30, on which the free ends of the bristle-like elements 30 can abut on rotation of the storage drum 3 in the selected direction of rotation (arrow v in FIGS. 4 to 6). These means can consist of recesses formed in the outrun section 32 or of radially projecting ribs or the like on the peripheral surface of the outrun section 32. Preferably these means 33 consist of grooves running parallel to the axis of rotation 8. Each bristle-like element 30 can be associated with one of these grooves but it would also be conceivable for these grooves to be associated only with selected, e.g. longer elements 30. The same applies to ribs which may be provided. Finally, the grooves preferably have a sawtooth cross-section (FIG. 4).

According to FIGS. 2 and 3 the outrun section 32 consists essentially of a separate disc, which is provided at its one major face with an encircling rim 34 projecting radially outwards and at its other major face with a coupling element 35. The rim 34 serves in known manner as a guide and support for the strand 12. On the other hand the coupling element 35 serves to connect the outrun section 32 to the storage section 31, in that the latter is provided with a corresponding, coaxial receiving aperture. The walls of this receiving aperture are preferably undercut to receive detent noses 36, which are formed on resilient tongues 37 of the coupling element 35 (FIGS. 1 to 3). For permanent, fixed attachment of the outrun section 32 to the storage section 31, the outrun section 32 has bores 38 for bolts or fixing screws, which are screwed into corresponding threaded bores in the storage section 31. Finally the outrun section 32 can comprise on its major face with the coupling element 35 a circumferential projection 40 of reduced diameter (FIG. 3) forming a shoulder 39, which is fitted without play in a corresponding enlargement of the receiving aperture of the storage section 31.

FIGS. 5 and 6 show the outrun section 32 and the brake ring 25 pushed on to it, greatly enlarged. It can be seen that the means 33 are so formed and arranged that the free ends of the bristle-like elements 30 automatically lie against and are supported by the associated means 33 on rotation of the outrun section 32 in the direction of the arrow v, so that the brake ring 25 necessarily has to follow the movements of the outrun section 32.

In the illustrated embodiment the bristle-like elements 30 are inclined from the base ring 29 oppositely to the direction of rotation (arrow v) of the storage drum or the outrun section 32. This is advantageous in that the strand portion which is drawn off through the air gap 41 visible in FIG. 6 runs in the stationary state of the storage drum 3 on the rim 34 opposite to that direction of rotation (arrow v) in which the storage drum 3 must be rotated in order to wind the strand 12 thereon. On account of this rotary movement opposite to the direction of the arrow v, the bristle-like elements 30 preferably have the inclination to the axis of rotation 8 and to the direction of rotation (arrow v) seen in the drawing. With the opposite inclination, the strand 12 could get into the gap between two adjacent elements 30 and then break.

The inclination of the elements 30 has the result that a large part of the forces which have to be absorbed by the elements 30 on acceleration of the storage drum 3 act in the longitudinal direction of the elements 30 (cf. FIG. 6). For this reason and also because of the small mass of the brake ring 25, preferably made in one piece of plastics material, this is entrained by the outrun section 32 reliably and through the interlock , even when the elements 30 are very elastic transverse to their longitudinal direction and accordingly deflect radially as soon as the strand 12 approaches the free end of an element 30 during take-off.

The means 33 formed as grooves or recesses preferably extend from the rim 34 to the opposite major face of the outrun section 32. The means 33 each then form a shoulder 42 (FIG. 5) in the region of the rim 34, on which an associated element 30 abuts in the axial direction, whereby the brake ring 25 is prevented from inadvertently slipping off the outrun section 32. However, on account of the elasticity of the elements 30, the brake ring 25 can be slipped off or pushed on to the outrun section 32 when required, over the mainly conically formed rim 34, without having to separate the outrun section 32 from the storage section 31.

When the means 33 are formed as grooves, recesses or the like, they have a sawtooth cross-section (FIGS. 4 and 6) in the embodiment at present considered the best. The arrangement is thus such that those surfaces 43 which are defined by the gradually rising ramps (FIG. 4) of the sawteeth run in front—considered in the direction of the arrow v—on rotation of the outrun section 32, while those surfaces 44 which are defined by the abruptly falling parts of the sawteeth (FIG. 4) run behind and are arranged substantially radially. Accordingly the surfaces 44 or the corners formed by the surfaces 43 and 44 each form an abutment face for an associated bristle-like element 30, the surfaces 43 additionally ensuring that the associated elements 30 enter the grooves or recesses reliably on starting the storage drum 3 and run on to the abutment faces 44.

In the described embodiment the combination of the elements 30 and the means 33 also act as a free-wheel, because if the brake ring 25 turns in the direction of the arrow v in the stationary state of the outrun section 32, or on rotation of the outrun section 32 in the direction opposite of that of the arrow v, the described interlock cannot be produced. This is, however, of no significance to the purpose of the invention. On the one hand the outrun section 32 is always turned in the same direction in operation while on the other hand the free-wheel could only come into action in any case with abrupt braking of the outrun section 32. This is, however, not normally the case, because the storage drum 3 stops slowly after disengaging the clutch.

The invention is not limited to the described embodiment, which can be modified in many respects. This applies in particular to the kind, arrangement and particular formation of the means 33, for which suitably arranged ribs could be used instead of grooves, the ribs projecting radially from the peripheral surface of the outrun section 32 and forming abutment faces corresponding to the faces 44. These abutment faces could also be continued over the region of the rim. It would further be possible to make the storage section 31 and the outrun section 32 in one piece, although the embodiment shown in the drawings is considered the best solution on account of its greater ease of manufacture. Manufacture in more than two sections is also conceivable; in particular the rim could be fitted as a separate part. Furthermore the expressions "thread" and "strand" is not limiting but is to be understood as a collective term for all thread-like materials, such as yarns, wires, ropes, cords or the like, which could be fed to a device using such a strand by means of the described feed device. Moreover the described strand feed device can also be so formed that it is only suited to non-positive overhead take-off of the strand and not for positive strand feed as well.

Differing from the illustrated embodiment, the bristle-like elements can also be arranged without an inclination to the axis of rotation 8, i.e. extending substantially axially and radially thereto. In this case the means 33 preferably consist of axially running grooves which each have two symmetrically arranged abutment surfaces corresponding to the surfaces 44. An advantage of such elements and grooves would consist in that the brake ring would be interlocked with the storage drum in both possible directions of rotation thereof.

Finally a second rim 45, the same as or similar to the rim 34, can be so fitted to the lower end in FIGS. 1 and 5 of the storage section of the storage drum 3 that the strand portion being taken off is supported on both rims 34 and 45 (FIG. 5) and runs through the air gap 41 at a location between the two rims (FIG. 6).

I claim:

1. Strand feed device comprising: a storage drum having an axis of rotation, a storage section and an outrun section, the storage and outrun sections forming a peripheral surface; and a brake ring fitted on said outrun section and having a base ring surrounding but spaced from the peripheral surface and elastic, bristle-like elements, which have ends fixed on the base ring and distributed over the periphery thereof, and free ends lying on the side of the base ring facing away from the storage section and cooperating with the peripheral surface, wherein a strand can be wound substantially tangentially on to the storage section through rotation of the storage drum and in dependence on an amount to be stored thereon, and withdrawn substantially axially over the outrun section and through the brake ring, and wherein the peripheral surface of the storage drum is provided with means forming abutment faces, against which the free ends of the elements abut on rotation of the storage drum and thereby couple the brake ring in form-locking manner with the storage drum.

2. Strand feed device according to claim 1, wherein said means forming abutment faces consist of recesses formed in the peripheral surface.

3. Strand feed device according to claim 1, wherein said abutment faces run transverse to the longitudinal direction of the elements.

4. Strand feed device according to claim 1, wherein said elements are inclined from said base ring in the direction of the peripheral surface and opposite to the direction of rotation of the storage drum.

5. Strand feed device according to claim 4, wherein the means forming abutment faces are so formed that there is no form-locking coupling between the storage drum and the brake ring in a direction opposite to the direction of rotation of the drum.

6. Strand feed device according to claim 1, wherein the means forming abutment faces consist of grooves parallel to the axis of rotation of the storage drum.

7. Strand feed device according to claim 1, wherein the means forming abutment faces are formed in the outrun section of the drum.

8. Strand feed device according to claim 1, wherein the outrun section of the drum is provided with a first rim at an end remote from the storage section.

9. Strand feed device according to claim 1, wherein the storage section and the outrun section consist of two individually manufactured parts.

10. Strand feed device according to claim 9, wherein the outrun section and the storage section include means for releasably connecting the sections together with each other.

11. Strand feed device according to clam 2, wherein the recesses have sawtooth cross-sectons.

12. Strand feed device according to claim 8, wherein the storage drum has a second rim between the storage section and the outrun section.

13. Strand feed device according to claim 12, wherein the brake ring is arranged between the first rim and the second rim.

* * * * *